US011498098B2

(12) United States Patent
Shu

(10) Patent No.: US 11,498,098 B2
(45) Date of Patent: Nov. 15, 2022

(54) HIERARCHICAL SEPARATING AND GRADING METHOD OF COAL GANGUE

(71) Applicant: Xinqian Shu, Beijing (CN)

(72) Inventor: Xinqian Shu, Beijing (CN)

(73) Assignee: Xinqian Shu, Beijing (CN)

( * ) Notice: Subject to any disclaimer, the term of this patent is extended or adjusted under 35 U.S.C. 154(b) by 49 days.

(21) Appl. No.: 17/245,178

(22) Filed: Apr. 30, 2021

(65) Prior Publication Data

US 2021/0339287 A1 Nov. 4, 2021

(30) Foreign Application Priority Data

Apr. 30, 2020 (CN) ..... 202010362764.0

(51) Int. Cl.
*B02C 23/14* (2006.01)
*B07B 15/00* (2006.01)

(52) U.S. Cl.
CPC ..... *B07B 15/00* (2013.01); *B02C 23/14* (2013.01)

(58) Field of Classification Search
CPC ..... B07B 7/08; B07B 15/00; B07B 2201/04; B02C 23/10; B02C 23/12; B02C 23/14; B02C 25/00
See application file for complete search history.

(56) References Cited

U.S. PATENT DOCUMENTS

| | | | | |
|---|---|---|---|---|
| 9,539,581 | B2 * | 1/2017 | Pickens | B02C 23/14 |
| 10,894,258 | B2 * | 1/2021 | Valerio | B03B 9/04 |
| 2011/0173878 | A1 * | 7/2011 | Jeong | F23J 1/00 44/620 |
| 2021/0094876 | A1 * | 4/2021 | Berodier | C04B 7/362 |
| 2022/0106235 | A1 * | 4/2022 | Guynn | C04B 28/10 |
| 2022/0134353 | A1 * | 5/2022 | Wang | B03B 7/00 209/3 |

FOREIGN PATENT DOCUMENTS

| | | | | |
|---|---|---|---|---|
| CN | 110075986 A | * | 8/2019 | B02C 21/02 |
| CN | 113245200 A | * | 8/2021 | B02C 23/14 |

* cited by examiner

*Primary Examiner* — Joseph C Rodriguez
(74) *Attorney, Agent, or Firm* — Troutman Pepper Hamilton Sanders LLP; Christopher C. Close, Jr.

(57) ABSTRACT

The present disclosure provides a hierarchical separating and grading method of coal gangue, and belongs to the technical field of coal gangue treatment and resource utilization. According to differences in the composition and properties of coal gangue, especially differences in Hardgrove grindability index (HGI), the present disclosure performs hierarchical crushing and screening to separate coal gangue into coal, sand, stone and soil. The coal can be used as a fuel for a coal gangue power plant or as an ordinary fuel. The sand and stone can be used to prepare manufactured sand and stone. The soil can replace loess for filling or preparing a building material. Obviously, by separating coal gangue into different components through hierarchical separating and grading, the present disclosure can achieve all-components utilization and effective reduction of the coal gangue.

9 Claims, 1 Drawing Sheet

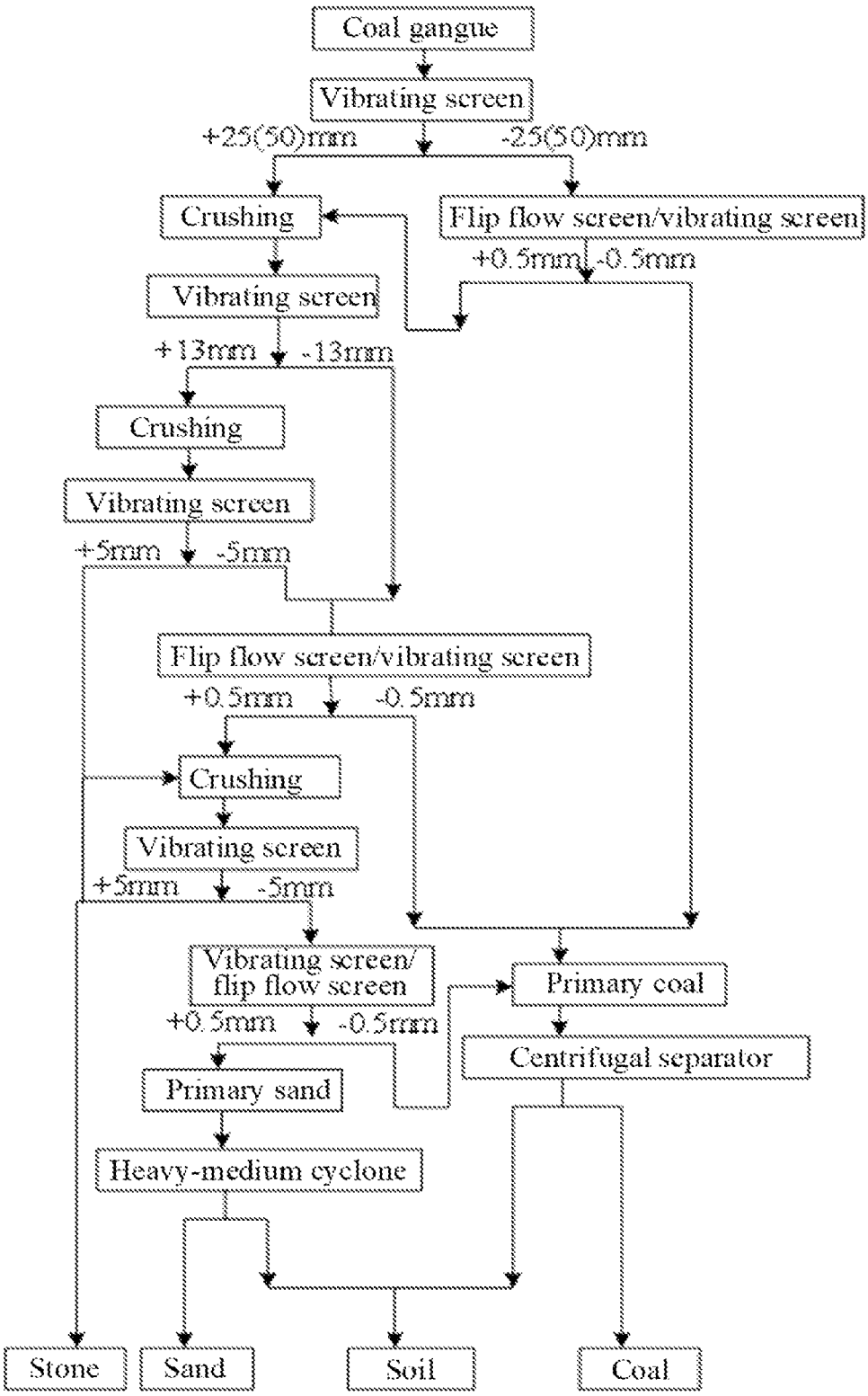
Coal gangue
Vibrating screen
+25(50)mm
-25(50)mm
Crushing
Flip flow screen/vibrating screen
+0.5mm
-0.5mm
Vibrating screen
+13mm
-13mm
Crushing
Vibrating screen
+5mm
-5mm
Flip flow screen/vibrating screen
+0.5mm
-0.5mm
Crushing
Vibrating screen
+5mm
-5mm
Vibrating screen/
flip flow screen
+0.5mm
-0.5mm
Primary coal
Centrifugal separator
Primary sand
Heavy-medium cyclone
Stone
Sand
Soil
Coal

HIERARCHICAL SEPARATING AND GRADING METHOD OF COAL GANGUE

CROSS REFERENCE TO RELATED APPLICATION

This patent application claims the benefit and priority of Chinese Patent Application No. 202010362764.0, filed on Apr. 30, 2020, the disclosure of which is incorporated by reference herein in its entirety as part of the present application.

TECHNICAL FIELD

The present disclosure relates to the technical field of coal gangue treatment and resource utilization, in particular to a hierarchical separating and grading method of coal gangue.

BACKGROUND ART

Due to the large-scale development and utilization of coal, a large amount of coal gangue is discharged, resulting in environmental pollution and waste of precious resources. In order to achieve comprehensive utilization and zero discharge of coal gangue, it is urgent to develop an efficient resource utilization technology.

At present, the research and application of coal gangue comprehensive utilization at home and abroad are concentrated in five fields. (1) Backfill: Coal gangue is used to fill goafs, roadbeds, foundations, low-lying land and subsidence land. (2) Fuel: Coal gangue is used independently or mixed with a certain amount of middlings, coal slime and tailings as a fuel for kilns or circulating fluidized bed (CFB) boilers. (3) Preparation of building materials: Coal gangue is used to prepare bricks, tiles, blocks, construction ceramsite and aggregates. (4) Preparation of chemical materials: Coal gangue includes a large amount of $SiO_2$, which can be extracted to produce white carbon black, sodium silicate, silicon carbide and other inorganic non-metallic materials. Coal gangue also includes a large amount of $Al_2O_3$, which can be extracted to prepare metallurgical grade $Al_2O_3$, chemical grade $Al_2O_3$, or $Al(OH)_3$. (5) Agricultural utilization: Some coal gangue includes high potassium, iron and other components, and can be used to produce mineral fertilizers and soil amendments, etc.

At present, the comprehensive utilization of coal gangue focuses on fuels and building materials, and the common practice is to break and crush coal gangue to a certain particle size for use. Due to the lack of reasonable and effective separation, coal and inorganic minerals are mixed, which greatly affects the utilization of coal gangue.

SUMMARY

In view of this, the present disclosure aims to provide a hierarchical separating and grading method of coal gangue. The present disclosure separates coal gangue to coal, sand, stone and soil by hierarchical selective crushing and screening, so as to achieve reasonable and effective utilization of the coal gangue based upon properties of different constituents themselves.

To achieve the objective of the present disclosure, the present disclosure provides the following technical solutions:

The present disclosure provides a hierarchical separating and grading method of coal gangue, including the following steps:

subjecting coal gangue with a ratio of $SiO_2/Al_2O_3$ greater than 1.25 to first screening by a first screening sieve having a sieve mesh of 50 or 25 mm to obtain a first screening oversize product and a first screening undersize product;

subjecting the first screening undersize product to second screening by a second screening sieve having a sieve mesh of 0.5 mm to obtain a second screening oversize product and a second screening undersize product;

mixing the first screening oversize product and the second screening oversize product, performing first crushing, and then performing third screening by a third screening sieve having a sieve mesh of 13 mm to obtain a third screening oversize product and a third screening undersize product;

subjecting the third screening oversize product to second crushing, and then performing fourth screening by a fourth screening sieve having a sieve mesh of 5 mm to obtain a fourth screening oversize product and a fourth screening undersize product;

mixing the third screening undersize product and the fourth screening undersize product, and then performing fifth screening by a fifth screening sieve having a sieve mesh of 0.5 mm to obtain a fifth screening oversize product and a fifth screening undersize product;

sampling and testing the fourth screening oversize product; using the fourth screening oversize product as stone when an ash content is greater than or equal to 90%; when the ash content is less than 90%, mixing the fourth screening oversize product and the fifth screening oversize product, performing third crushing, then performing sixth screening by a sixth screening sieve having a sieve mesh of 5 mm to obtain a sixth screening oversize product and a sixth screening undersize product, and using the sixth screening oversize product as stone;

subjecting the sixth screening undersize product to seventh screening by a seventh screening sieve having a sieve mesh of 0.5 mm to obtain a seventh screening oversize product and a seventh screening undersize product;

separating the seventh screening oversize product into soil, sand and stone;

using the second screening undersize product, the fifth screening undersize product and the seventh screening undersize product as coal.

Preferably, the second screening sieve may be selected according to an air-dried moisture content (Mad) and a plasticity index (Ip) of the coal gangue;

when Mad≥12% and Ip≥12, a flip-flow screen may be selected to screen the coal gangue;

when Mad≤6% and Ip≤7, a vibrating screen may be selected to screen the coal gangue; and when Mad=6-12% and Ip=7-12, a flip-flow screen or a vibrating screen may be selected according to a sliming level of the coal gangue; when the coal gangue has a low sliming level, the coal gangue may be screened with a vibrating screen; when the coal gangue has a medium sliming level or above, the coal gangue may be screened with a flip-flow screen.

Preferably, different crushers may be selected for first crushing according to a Hardgrove grindability index (HGI) of the coal gangue;

when HGI≥65, a hammer crusher or a roll crusher may be selected;

when HGI=45-65, an impact crusher or a hammer crusher may be selected; and when HGI≤45, an impulse crusher or an impact crusher may be selected.

Preferably, the separating may be performed by a heavy-medium cyclone.

Preferably, the separating may be performed with a heavy-medium suspension with a specific gravity of 2-2.20 g/cm$^3$ to obtain soil (low density), sand and stone.

Preferably, the first screening, the third screening, the fourth screening and the sixth screening may be performed by a vibrating screen.

Preferably, the second screening, the fifth screening and the seventh screening may be performed independently by a flip-flow screen or a vibrating screen.

Preferably, the method may further include determining mineral composition, chemical composition, density, particle size, crushing property, surface property, Ip and sliming level of the coal gangue before the first screening.

The present disclosure provides a hierarchical separating and grading method of coal gangue. The method includes the following steps: subjecting coal gangue with a ratio of $SiO_2/Al_2O_3$ greater than 1.25 to first screening by a first screening sieve having a sieve mesh of 50 or 25 mm to obtain a first screening oversize product and a first screening undersize product; subjecting the first screening undersize product to second screening by a second screening sieve having a sieve mesh of 0.5 mm to obtain a second screening oversize product and a second screening undersize product; mixing the first screening oversize product and the second screening oversize product, performing first crushing, and then performing third screening by a third screening sieve having a sieve mesh of 13 mm to obtain a third screening oversize product and a third screening undersize product; subjecting the third screening oversize product to second crushing, and then performing fourth screening by a fourth screening sieve having a sieve mesh of 5 mm to obtain a fourth screening oversize product and a fourth screening undersize product; mixing the third screening undersize product and the fourth screening undersize product, and then performing fifth screening by a fifth screening sieve having a sieve mesh of 0.5 mm to obtain a fifth screening oversize product and a fifth screening undersize product; sampling and testing the fourth screening oversize product; using the fourth screening oversize product as stone when an ash content is greater than or equal to 90%; when the ash content is less than 90%, mixing the fourth screening oversize product and the fifth screening oversize product, performing third crushing, then performing sixth screening by a sixth screening sieve having a sieve mesh of 5 mm to obtain a sixth screening oversize product and a sixth screening undersize product, and using the sixth screening oversize product as stone; subjecting the sixth screening undersize product to seventh screening by a seventh screening sieve having a sieve mesh of 0.5 mm to obtain a seventh screening oversize product and a seventh screening undersize product; separating the seventh screening oversize product into soil, sand and stone; and using the second screening undersize product, the fifth screening undersize product and the seventh screening undersize product as coal. According to differences in the composition and properties of the coal gangue, especially differences in the HGI, the present disclosure performs hierarchical selective crushing and screening to separate the coal gangue into coal, sand, stone and soil. The coal can be used as a fuel for a coal gangue power plant or as an ordinary fuel. The sand and stone can be used to prepare manufactured sand and stone. The soil can replace loess for filling or preparing a building material. In this way, the present disclosure can achieve the effective all-components resource utilization and effective reduction of coal gangue, and even to coming to zero discharge of coal gangue.

BRIEF DESCRIPTION OF THE DRAWINGS

FIG. 1 is a flowchart of a hierarchical separating and grading method of coal gangue according to an embodiment of the present disclosure.

DETAILED DESCRIPTION OF THE EMBODIMENTS

The present disclosure provides a hierarchical separating and grading method of coal gangue. The method includes the following steps:

Subject coal gangue with a ratio of $SiO_2/Al_2O_3$ greater than 1.25 to first screening by a first screening sieve having a sieve mesh of 50 or 25 mm to obtain a first screening oversize product and a first screening undersize product.

Subject the first screening undersize product to second screening by a second screening sieve having a sieve mesh of 0.5 mm to obtain a second screening oversize product and a second screening undersize product.

Mix the first screening oversize product and the second screening oversize product, perform first crushing, and then perform third screening by a third screening sieve having a sieve mesh of 13 mm to obtain a third screening oversize product and a third screening undersize product.

Subject the third screening oversize product to second crushing, and then perform fourth screening by a fourth screening sieve having a sieve mesh of 5 mm to obtain a fourth screening oversize product and a fourth screening undersize product.

Mix the third screening undersize product and the fourth screening undersize product, and then perform fifth screening by a fifth screening sieve having a sieve mesh of 0.5 mm to obtain a fifth screening oversize product and a fifth screening undersize product.

Sample and test the fourth screening oversize product; use the fourth screening oversize product as stone when an ash content is greater than or equal to 90%; when the ash content is less than 90%, mix the fourth screening oversize product and the fifth screening oversize product, perform third crushing, then perform sixth screening by a sixth screening sieve having a sieve mesh of 5 mm to obtain a sixth screening oversize product and a sixth screening undersize product, and use the sixth screening oversize product as stone.

Subject the sixth screening undersize product to seventh screening by a seventh screening sieve having a sieve mesh of 0.5 mm to obtain a seventh screening oversize product and a seventh screening undersize product.

Separate the seventh screening oversize product into soil, sand and stone.

Use the second screening undersize product, the fifth screening undersize product and the seventh screening undersize product as coal.

The present disclosure subjects coal gangue with a ratio of $SiO_2/Al_2O_3$ greater than 1.25 to first screening by a first screening sieve having a sieve mesh of 50 or 25 mm to obtain a first screening oversize product and a first screening undersize product. In the present disclosure, the first screening is preferably performed by a vibrating screen.

In the present disclosure, the method preferably further includes determining mineral composition, chemical composition, density, particle size, crushing property, surface property, plasticity index (Ip) and sliming level of the coal gangue before the first screening. The present disclosure has no special limit on the method of determining, and a method known to those skilled in the art may be used.

In the present disclosure, preferably, coal gangue with a ratio of $SiO_2/Al_2O_3$ not greater than 1.25 is directly crushed and screened before coal and a clay mineral are separated by a conventional separation method. The present disclosure has no special limit on the methods of crushing and screening and the conventional separation method, and methods known to those skilled in the art may be used.

After obtaining the first screening undersize product, the present disclosure subjects the first screening undersize product to second screening by a second screening sieve having a sieve mesh of 0.5 mm to obtain a second screening oversize product and a second screening undersize product. The second screening undersize product is used as coal. In the present disclosure, the first screening and the second screening are performed to prevent large and small particles from being mixed to affect the separation efficiency.

In the present disclosure, preferably, the second screening sieve is selected according to an air-dried moisture content (Mad) and an Ip of the coal gangue. When Mad≥12% and Ip≥12, a flip-flow screen is preferably selected. When Mad≤6% and Ip≤7, a vibrating screen is preferably selected. When Mad=6-12% and Ip=7-12, a flip-flow screen or a vibrating screen is preferably selected according to a sliming level of the coal gangue. When the coal gangue has a low sliming level, the coal gangue is preferably screened with a vibrating screen. When the coal gangue has a medium sliming level or above, the coal gangue is preferably screened with a flip-flow screen.

After obtaining the first screening oversize product and the second screening oversize product, the present disclosure mixes the first screening oversize product and the second screening oversize product, performs first crushing, and then performs third screening by a third screening sieve having a sieve mesh of 13 mm to obtain a third screening oversize product and a third screening undersize product.

In the present disclosure, preferably, different crushers are selected for first crushing according to a Hardgrove grindability index (HGI) of the coal gangue. When HGI≥65, a hammer crusher or a roll crusher is selected. When HGI=45-65, an impact crusher or a hammer crusher is selected. When HGI≤45, an impulse crusher or an impact crusher is selected. After being crushed, the material is screened.

After obtaining the third screening oversize product, the present disclosure subjects the third screening oversize product to second crushing, and then performs fourth screening by a fourth screening sieve having a sieve mesh of 5 mm to obtain a fourth screening oversize product and a fourth screening undersize product.

After obtaining the third screening undersize product and the fourth screening undersize product, the present disclosure mixes the third screening undersize product and the fourth screening undersize product, and then performs fifth screening by a fifth screening sieve having a sieve mesh of 0.5 mm to obtain a fifth screening oversize product and a fifth screening undersize product. The fifth screening undersize product is used as coal.

After obtaining the fourth screening oversize product, the present disclosure samples and tests the fourth screening oversize product, and uses the fourth screening oversize product as stone when an ash content is greater than or equal to 90%. When the ash content is less than 90%, the present disclosure mixes the fourth screening oversize product and the fifth screening oversize product, performs third crushing, then performs sixth screening by a sixth screening sieve having a sieve mesh of 5 mm to obtain a sixth screening oversize product and a sixth screening undersize product, and uses the sixth screening oversize product as stone.

After obtaining the sixth screening undersize product, the present disclosure subjects the sixth screening undersize product to seventh screening by a seventh screening sieve having a sieve mesh of 0.5 mm to obtain a seventh screening oversize product (coarse sand) and a seventh screening undersize product (coal).

After obtaining the seventh screening oversize product, the present disclosure separates the seventh screening oversize product into soil, sand and stone.

In the present disclosure, the separating is preferably performed by a heavy-medium cyclone.

In the present disclosure, the separating is preferably performed with a heavy-medium suspension with a specific gravity of 2-2.20 g/cm$^3$ to obtain soil (low density), sand and stone.

The present disclosure preferably further includes: pass the second screening undersize product, the fifth screening undersize product and the seventh screening oversize product through a centrifugal separator to obtain coal and soil.

In the present disclosure, the first screening, the third screening, the fourth screening and the sixth screening are preferably performed by a vibrating screen.

In the present disclosure, the second screening, the fifth screening and the seventh screening are preferably performed independently by a flip-flow screen or a vibrating screen.

The key to the hierarchical separating and grading of the coal gangue in the present disclosure is selective crushing. Depending on the properties of the coal gangue components, appropriate crushing processes are selected to fully disintegrate the coal gangue into coal, sand, stone and soil. Then effective screening and separation are performed according to different particle sizes, thereby achieving the purpose of hierarchical separating and grading.

In order to further illustrate the present disclosure, the hierarchical separating and grading method of coal gangue provided by the present disclosure is described in detail below with reference to the embodiments, but the embodiments should not be understood as limiting the protection scope of the present disclosure.

FIG. 1 is a flowchart of a hierarchical separating and grading method of coal gangue according to an embodiment of the present disclosure. The method includes the following steps: Subject coal gangue with a ratio of $SiO_2/Al_2O_3$ greater than 1.25 to first screening by a first screening sieve having a sieve mesh of 50 or 25 mm to obtain a first screening oversize product and a first screening undersize product. Subject the first screening undersize product to second screening to obtain a second screening oversize product and a second screening undersize product, a second screening sieve having a sieve mesh of 0.5 mm. Mix the first screening oversize product and the second screening oversize product, perform first crushing, and then perform third screening by a third screening sieve having a sieve mesh of 13 mm to obtain a third screening oversize product and a third screening undersize product. Subject the third screening oversize product to second crushing, and then perform fourth screening by a fourth screening sieve having a sieve mesh of 5 mm to obtain a fourth screening oversize product and a fourth screening undersize product. Mix the third screening undersize product and the fourth screening undersize product, and then perform fifth screening by a fifth screening sieve having a sieve mesh of 0.5 mm to obtain a fifth screening oversize product and a fifth screening undersize product. Sample and test the fourth screening oversize product; use the fourth screening oversize product as stone when an ash content is greater than or equal to 90%; when the ash content is less than 90%, mix the fourth screening oversize product and the fifth screening oversize product, perform third crushing, then perform sixth screening by a sixth screening sieve having a sieve mesh of 5 mm to obtain a sixth screening oversize product and a sixth screening undersize product, and use the sixth screening oversize product as stone. Subject the sixth screening undersize product to seventh screening by a seventh screening sieve having a sieve mesh of 0.5 mm to obtain a seventh screening oversize product (coarse sand) and a seventh screening undersize product. Separate the seventh screening oversize product by a heavy-medium cyclone into soil and sand. Separate the second screening undersize product, the fifth screening undersize product and the seventh screening undersize product by a centrifugal separator into coal and soil.

Embodiment 1

The composition and properties of coal gangue discharged from a coal preparation plant in a mining area were first investigated, as shown in Table 1. Then, the coal gangue was subjected to hierarchical separating and grading. The coal gangue was screened by 25 mm and 0.5 mm vibrating screen. A −0.5 mm product was used as coal, and a +0.5 mm product was crushed by an impact crusher and screened by 13 mm and 0.5 mm vibrating screen. A +0.5 mm product was crushed by the crusher, and screened by 5 mm and 0.5 mm screens. A +5 mm oversize product was analyzed and tested, and it was used as stone when an ash content reached 91.17%. An undersize product of the 0.5 mm sieve was mixed with the above 0.5 mm undersize product as coal. 0.5-5 mm products were separated by a heavy-medium cyclone into soil (low density), sand and stone.

Through the above treatment process, 10.69 wt % coal, 5.76 wt % stone, 37.75 wt % sand and 45.80 wt % soil were obtained.

TABLE 1

Composition and properties of coal gangue

| Composition and properties | Mad % | Chemical composition/% $SiO_2$ | $Al_2O_3$ | $Fe_2O_3$ | $K_2O$ | $TiO_2$ | CaO | $Na_2O$ | MgO | $SiO_2/Al_2O_3$ | Ip | HGI |
|---|---|---|---|---|---|---|---|---|---|---|---|---|
| Value | 5.59 | 58.19 | 29.34 | 4.96 | 2.28 | 1.57 | 1.34 | 0.62 | 0.55 | 1.98 | 7.9 | 57.9 |

Embodiment 2

The composition and properties of coal gangue discharged from a coal preparation plant in a mining area were first investigated, as shown in Table 2. Then, the coal gangue was subjected to hierarchical separating and grading. The coal gangue was screened by a 25 mm vibrating screen and a 0.5 mm flip-flow screen, and a −0.5 mm product was used as coal. A +0.5 mm product was crushed by a hammer crusher, and screened by a 13 mm vibrating screen and a 0.5 mm flip-flow screen. A +0.5 mm product was crushed by a hammer crusher, and screened by a 5 mm vibrating screen and a 0.5 mm flip-flow screen. A +5 mm oversize product was analyzed and tested to have an ash content of 82.36%. Then this product was crushed by the crusher, and screened by a 0.5 mm flip-flow screen. An undersize product was mixed with the above −0.5 mm product as coal. An oversize product was separated by a heavy-medium cyclone into soil (low density), sand and stone.

Through the above treatment process, 15.35 wt % coal, 37.46 wt % sand and stone and 47.19 wt % soil were obtained.

TABLE 2

Composition and properties of coal gangue

| Composition and properties | Mad % | Chemical composition/% $SiO_2$ | $Al_2O_3$ | $Fe_2O_3$ | $K_2O$ | $TiO_2$ | CaO | $Na_2O$ | MgO | $SiO_2/Al_2O_3$ | Ip | HGI |
|---|---|---|---|---|---|---|---|---|---|---|---|---|
| Value | 8.53 | 56.52 | 29.91 | 9.61 | 1.20 | 0.75 | 0.71 | 0.15 | 0.53 | 1.89 | 9.9 | 66.8 |

Embodiment 3

The composition and properties of coal gangue discharged from a coal preparation plant in a mining area were first investigated, as shown in Table 3. Then, the coal gangue was subjected to hierarchical separating and grading. The coal gangue was screened by 25 mm and 0.5 mm vibrating screens, and a −0.5 mm product was used as coal. A +0.5 mm product was crushed by an impact crusher, and screened by 13 mm and 0.5 mm vibrating screens. A +0.5 mm product was crushed by a hammer crusher, and screened by 5 mm and 0.5 mm vibrating screens. A +5 mm oversize product was analyzed and tested to have an ash content of 90.34%, and it might be used as stone. An undersize product of the 0.5 mm sieve was mixed with the above 0.5 mm product as coal. 0.5-5 mm products were separated by a heavy-medium cyclone into soil (low density), sand and stone.

Through the above treatment process, 10.69 wt % coal, 45.75 wt % sand and stone and 43.56 wt % soil were obtained.

TABLE 3

| Composition and properties of coal gangue | | | | | | | | | | | | |
|---|---|---|---|---|---|---|---|---|---|---|---|---|
| Composition and | Mad | Chemical composition/% | | | | | | | | $SiO_2$/ | | |
| properties | % | $SiO_2$ | $Al_2O_3$ | $Fe_2O_3$ | $K_2O$ | $TiO_2$ | CaO | $Na_2O$ | MgO | $Al_2O_3$ | Ip | HGI |
| Value | 3.47 | 61.06 | 26.79 | 5.35 | 1.16 | 0.76 | 0.13 | 0.13 | 0.40 | 2.28 | 7.1 | 51.3 |

Embodiment 4

The composition and properties of coal gangue discharged from a coal preparation plant in a mining area were first investigated, as shown in Table 4. Then, the coal gangue was subjected to hierarchical separating and grading. The coal gangue was screened by 25 mm and 0.5 mm vibrating screens. A −0.5 mm product was used as coal, and a +0.5 mm product was crushed by an impulse crusher and screened by 13 mm and 0.5 mm vibrating screens. A +0.5 mm product was crushed by an impact crusher, and screened by 5 mm and 0.5 mm vibrating screens. A 5 mm oversize product was analyzed and tested to have an ash content of 91.29%, and it might be used as stone. An undersize product of the −0.5 mm sieve was mixed with the above −0.5 mm product as coal. 0.5-5 mm products were separated by a heavy-medium cyclone into soil (low density), sand and stone.

Through the above treatment process, 6.85 wt % coal, 5.49 wt % stone, 46.56 wt % sand and 41.10 wt % soil were obtained.

TABLE 4

| Composition and properties of coal gangue | | | | | | | | | | | | |
|---|---|---|---|---|---|---|---|---|---|---|---|---|
| Composition and | Mad | Chemical composition/% | | | | | | | | $SiO_2$/ | | |
| properties | % | $SiO_2$ | $Al_2O_3$ | $Fe_2O_3$ | $K_2O$ | $TiO_2$ | CaO | $Na_2O$ | MgO | $Al_2O_3$ | Ip | HGI |
| Value | 2.36 | 59.22 | 25.75 | 5.21 | 3.37 | 1.61 | 1.33 | 0.75 | 1.41 | 2.30 | 6.6 | 45.7 |

Embodiment 5

The composition and properties of coal gangue discharged from a coal preparation plant in a mining area were first investigated, as shown in Table 5. Then, the coal gangue was subjected to hierarchical separating and grading. The coal gangue was screened by 50 mm and 0.5 mm vibrating screens, and a −0.5 mm product was used as coal. A +0.5 mm product was crushed by an impulse crusher, and screened by 13 mm and 0.5 mm vibrating screens. A +0.5 mm product was crushed by an impact crusher, and screened by 5 mm and 0.5 mm vibrating screens. A +5 mm oversize product was analyzed and tested to have an ash content of 92.79%, and it might be used as sand and stone. An undersize product of the 0.5 mm sieve was mixed with the above −0.5 mm product as coal. 0.5-5 mm products were separated by a heavy-medium cyclone into soil (low density), sand and stone.

Through the above treatment process, 5.39 wt % coal, 6.07 wt % stone, 48.98 wt % sand and 39.56% soil were obtained.

Table 5 Composition and properties of coal gangue

TABLE 5

| Composition and properties of coal gangue | | | | | | | | | | | | |
|---|---|---|---|---|---|---|---|---|---|---|---|---|
| Composition and | Mad | Chemical composition/% | | | | | | | | $SiO_2$/ | | |
| properties | % | $SiO_2$ | $Al_2O_3$ | $Fe_2O_3$ | $K_2O$ | $TiO_2$ | CaO | $Na_2O$ | MgO | $Al_2O_3$ | Ip | HGI |
| Value | 1.21 | 56.10 | 21.08 | 3.88 | 2.42 | 0.81 | 1.28 | 0.50 | 0.74 | 2.66 | 6.1 | 42.8 |

The above described are merely preferred implementations of the present disclosure rather than limitations on the present disclosure in any form. It should be noted that a person with ordinary skill in the art may further make several improvements and modifications without departing from the principle of the present disclosure, but such improvements and modifications should be deemed as falling within the protection scope of the present disclosure.

What is claimed is:

1. A hierarchical separating and grading method of coal gangue, comprising the following steps:

subjecting coal gangue with a ratio of $SiO_2/Al_2O_3$ greater than 1.25 to first screening by a first screening sieve having a sieve mesh of 50 or 25 mm to obtain a first screening oversize product and a first screening undersize product;

subjecting the first screening undersize product to second screening by a second screening sieve having a sieve mesh of 0.5 mm to obtain a second screening oversize product and a second screening undersize product;

mixing the first screening oversize product and the second screening oversize product, performing first crushing, and then performing third screening by a third screening sieve having a sieve mesh of 13 mm to obtain a third screening oversize product and a third screening undersize product;

subjecting the third screening oversize product to second crushing, and then performing fourth screening by a fourth screening sieve having a sieve mesh of 5 mm to obtain a fourth screening oversize product and a fourth screening undersize product;

mixing the third screening undersize product and the fourth screening undersize product, and then performing fifth screening by a fifth screening sieve having a sieve mesh of 0.5 mm to obtain a fifth screening oversize product and a fifth screening undersize product;

sampling and testing the fourth screening oversize product; using the fourth screening oversize product as stone when an ash content is greater than or equal to 90%; when the ash content is less than 90%, mixing the fourth screening oversize product and the fifth screening oversize product, performing third crushing, then performing sixth screening by a sixth screening sieve having a sieve mesh of 5 mm to obtain a sixth screening oversize product and a sixth screening undersize product, and using the sixth screening oversize product as stone;

subjecting the sixth screening undersize product to seventh screening by a seventh screening sieve having a sieve mesh of 0.5 mm to obtain a seventh screening oversize product and a seventh screening undersize product;

separating the seventh screening oversize product into soil, sand and stone; and using the second screening undersize product, the fifth screening undersize product and the seventh screening undersize product as coal.

2. The hierarchical separating and grading method according to claim 1, wherein the second screening sieve is selected according to an air-dried moisture content (Mad) and a plasticity index (Ip) of the coal gangue;

when Mad≥12% and Ip≥12, a flip-flow screen is selected;

when Mad≤6% and Ip≤7, a vibrating screen is selected; and when Mad=6-12% and Ip=7-12, the flip-flow screen or the vibrating screen is selected according to a sliming level of the coal gangue; when the coal gangue has a low sliming level, the coal gangue is screened with the vibrating screen; when the coal gangue has a medium sliming level or above, the coal gangue is screened with the flip-flow screen.

3. The hierarchical separating and grading method according to claim 1, wherein different crushers are selected for the first crushing according to a Hardgrove grindability index (HGI) of the coal gangue;

when HGI≥65, a hammer crusher or a roll crusher is selected;

when HGI=45-65, an impact crusher or the hammer crusher is selected; and when HGI≤45, an impulse crusher or the impact crusher is selected.

4. The hierarchical separating and grading method according to claim 1, wherein the separating is performed by a heavy-medium cyclone.

5. The hierarchical separating and grading method according to claim 1, wherein the separating is performed with a heavy-medium suspension with a specific gravity of 2-2.20 $g/cm^3$ to obtain soil (low density), sand and stone.

6. The hierarchical separating and grading method according to claim 1, wherein the first screening, the third screening, the fourth screening and the sixth screening are performed by a vibrating screen.

7. The hierarchical separating and grading method according to claim 1, wherein the second screening, the fifth screening and the seventh screening are performed independently by a flip-flow screen or a vibrating screen.

8. The hierarchical separating and grading method according to claim 1, wherein the method further comprises determining mineral composition, chemical composition, density, particle size, crushing property, surface property, Ip and sliming level of the coal gangue before the first screening.

9. The hierarchical separating and grading method according to claim 4, wherein the separating is performed with a heavy-medium suspension with a specific gravity of 2-2.20 $g/cm^3$ to obtain soil (low density), sand and stone.

* * * * *